US010041341B2

(12) United States Patent
Kerr et al.

(10) Patent No.: US 10,041,341 B2
(45) Date of Patent: Aug. 7, 2018

(54) PROCESSES FOR PRODUCING HYDROCARBONS FROM A RESERVOIR

(71) Applicant: NEXEN ENERGY ULC, Calgary (CA)

(72) Inventors: Richard Kelso Kerr, Calgary (CA); Thomas Harding, Calgary (CA)

(73) Assignee: NEXEN ENERGY ULC, Alberta (CA)

( * ) Notice: Subject to any disclaimer, the term of this patent is extended or adjusted under 35 U.S.C. 154(b) by 298 days.

(21) Appl. No.: 15/035,114

(22) PCT Filed: Nov. 6, 2014

(86) PCT No.: PCT/CA2014/000795

§ 371 (c)(1),
(2) Date: May 6, 2016

(87) PCT Pub. No.: WO2015/066796

PCT Pub. Date: May 14, 2015

(65) Prior Publication Data

US 2016/0273326 A1 Sep. 22, 2016

Related U.S. Application Data

(60) Provisional application No. 61/900,688, filed on Nov. 6, 2013, provisional application No. 61/900,677, filed (Continued)

(51) Int. Cl.
*E21B 43/24* (2006.01)
*E21B 36/04* (2006.01)

(Continued)

(52) U.S. Cl.
CPC ..... *E21B 43/2406* (2013.01); *E21B 36/04* (2013.01); *E21B 43/2401* (2013.01);

(Continued)

(58) Field of Classification Search
CPC .... E21B 43/24; E21B 43/2406; E21B 47/065; E21B 36/04; E21B 43/2401; E21B 43/2408; E21B 47/00; E21B 43/121
See application file for complete search history.

(56) References Cited

U.S. PATENT DOCUMENTS 4,085,803 A * 4/1978 Butler ..... E21B 36/00 166/303
8,656,998 B2 * 2/2014 Dong ..... E21B 43/2408 166/272.3

(Continued)

FOREIGN PATENT DOCUMENTS

CA 2304938 A1 * 2/2001 ..... C09K 8/592
CA 2773056 C 11/2015
WO 2013007297 A1 1/2013

OTHER PUBLICATIONS

WIPO, International Preliminary Report on Patentability for International Application No. PCTCA2014000795 dated May 10, 2016.

(Continued)

*Primary Examiner* — Michael R Wills, III
(74) *Attorney, Agent, or Firm* — Norton Rose Fulbright Canada LLP; Paul J. Field

(57) ABSTRACT

There is provided a process for producing hydrocarbons from a reservoir. The process includes within the hydrocarbon reservoir, electrically heating a liquid heating fluid such that the liquid heating fluid is evaporated to produce a gaseous heating fluid, heating hydrocarbon-comprising material with the gaseous heating fluid such that the heated hydrocarbon-comprising material is mobilized and such that the gaseous heating fluid is condensed to produce a condensed heating fluid, and electrically heating at least a fraction of the condensed heating fluid such that the at least a condensed heating fluid fraction is re-evaporated, and while the evaporation, the condensing, and the re-evapora- (Continued)

tion are being effected, producing a produced fluid including at least the mobilized hydrocarbon-comprising material.

12 Claims, 8 Drawing Sheets

Related U.S. Application Data on Nov. 6, 2013, provisional application No. 61/900,663, filed on Nov. 6, 2013, provisional application No. 61/901,704, filed on Nov. 8, 2013.

(51) Int. Cl.
*E21B 47/00* (2012.01)
*E21B 47/06* (2012.01)

(52) U.S. Cl.
CPC ..... *E21B 43/2408* (2013.01); *E21B 47/00* (2013.01); *E21B 47/065* (2013.01)

(56) References Cited

U.S. PATENT DOCUMENTS

2011/0108273 A1 5/2011 Huber et al.
2011/0259590 A1* 10/2011 Burnham ..... E21B 43/121 166/302
2011/0303423 A1* 12/2011 Kaminsky ..... C09K 8/58 166/400
2013/0008651 A1 1/2013 Trautman et al.
2013/0199786 A1* 8/2013 McConaghy ..... E21B 43/121 166/302
2013/0312959 A1* 11/2013 Hytken ..... E21B 43/2406 166/272.3
2014/0054028 A1 2/2014 Little et al.

OTHER PUBLICATIONS

WIPO, International Search Report and Written Opinion for International Application No. PCTCA2014000795 dated Feb. 3, 2015.
WIPO, International Search Report and Written Opinion for International Application No. PCTCA2015000299 dated Aug. 19, 2015.
CIPO, Office Action for CA Application No. 2,929,750 dated Mar. 1, 2017.
CIPO, Office Action for CA Application No. 2,940,056 dated Feb. 23, 2017.

* cited by examiner

PROCESSES FOR PRODUCING HYDROCARBONS FROM A RESERVOIR

FIELD

The present disclosures relates to improvements in production of hydrocarbon-comprising material from hydrocarbon-bearing reservoirs.

BACKGROUND

Thermal enhanced oil recovery methods are used to recover bitumen and heavy oil from hydrocarbon reservoirs. The most dominant of these methods is steam-assisted gravity drainage ("SAGD"). SAGD operations are impaired by energy losses and hydraulic pressure losses suffered by fluids being conducted through the injection and production wells. As well, SAGD operations are particularly susceptible to fluid incursions from active water zones, which may disrupt the SAGD process.

SUMMARY

In one aspect, there is provided a process for producing hydrocarbons from a reservoir, including:

within the hydrocarbon reservoir, electrically heating a liquid heating fluid such that the liquid heating fluid is evaporated to produce a gaseous heating fluid;

heating hydrocarbon-comprising material with the gaseous heating fluid such that the heated hydrocarbon-comprising material is mobilized and such that the gaseous heating fluid is condensed to produce a condensed heating fluid;

electrically heating at least a fraction of the condensed heating fluid such that the at least a condensed heating fluid fraction is re-evaporated; and while the evaporation, the condensing, and the re-evaporation are being effected, producing a produced fluid including at least the mobilized hydrocarbon-comprising material.

In another aspect, there is provided a process for producing hydrocarbon-comprising material from an hydrocarbon reservoir comprising:

operating a first steam-assisted gravity drainage ("SAGD") system including a first SAGD well pair, wherein the first SAGD well pair includes a first SAGD injection well and a first SAGD production well, such that hydrocarbon-comprising material is produced from the first SAGD production well;

operating a second SAGD system including a second SAGD well pair, wherein the second SAGD well pair includes a second SAGD injection well and a second SAGD production well, such that hydrocarbon-comprising material is produced from the second SAGD production well; and after a first steam chamber has been created by operation of the first SAGD system and a second steam chamber has been created by operation of the second SAGD system, and respective hydrocarbon-comprising material production has been being effected by each one of the operation of the first SAGD system and the operation of the second SAGD system, independently, such that a wedge zone has been formed within the hydrocarbon reservoir between the first and second steam chambers, operating an in situ-reflux process within the wedge zone for producing hydrocarbon-comprising material from the wedge zone.

In a further aspect, there is provided a process for producing hydrocarbon-comprising material from an hydrocarbon reservoir, including:

operating a first steam-assisted gravity drainage ("SAGD") system including a first SAGD well pair, wherein the first SAGD well pair includes a first SAGD injection well and a first SAGD production well, such that hydrocarbon-comprising material is produced from the first SAGD production well;

operating a second SAGD system including a second SAGD well pair, wherein the second SAGD well pair including a second SAGD injection well and a second SAGD production well, such that hydrocarbon-comprising material is produced from the second SAGD production well; and after respective hydrocarbon-comprising material production has been effected by each one of the operation of the first SAGD system and the operation of the second SAGD system, independently, operating an in-situ reflux process, wherein the operating of an in-situ reflux process includes:

within the hydrocarbon reservoir, electrically heating a liquid heating fluid such that the liquid heating fluid is evaporated to produce a gaseous heating fluid;

heating hydrocarbon-comprising material, within an intermediate hydrocarbon reservoir zone disposed between the first and second SAGD well pairs, with the gaseous heating fluid such that the heated hydrocarbon-comprising material is mobilized and such that the gaseous first heating fluid is condensed to produce a condensed heating fluid;

electrically heating at least a fraction of the condensed heating fluid such that the at least a condensed heating fluid fraction is re-evaporated; and while the evaporation, the condensing, and the re-evaporation is being effected, producing reservoir fluid, including at least a fraction of the mobilized hydrocarbon-comprising material, through an intermediate production well.

BRIEF DESCRIPTION OF THE DRAWINGS

In the drawings, embodiments of the invention are illustrated by way of example. It is to be expressly understood that the description and drawings are only for the purpose of illustration and as an aid to understanding, and are not intended as a definition of the limits of the invention.

Embodiments will now be described, by way of example only, with reference to the attached figures, wherein.

DETAILED DESCRIPTION

Figure 1:
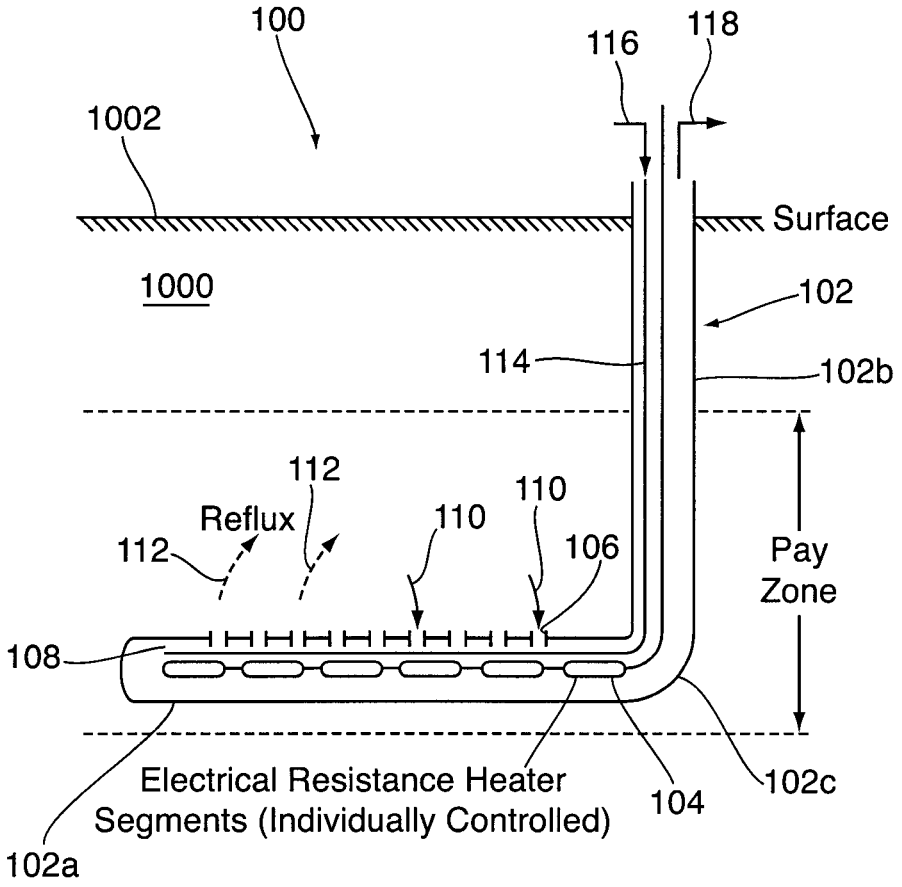
FIG. 1 is a schematic illustration of an embodiment of a system, with a single well, used to implement the in-situ reflux process.

There is provided a process for producing hydrocarbon-comprising material from a hydrocarbon reservoir.

In some embodiments, for example, the hydrocarbon-comprising material being produced includes, or is substantially, a liquid hydrocarbon. In some embodiments, for example, the hydrocarbon-comprising material includes bitumen. In some of these embodiments, for example, the bitumen is a liquid hydrocarbon material with an API gravity less than, or equal to, 10, and with an in situ viscosity of greater than 10,000 centipoise. In some embodiments, for example, the hydrocarbon-comprising material includes heavy oil.

In some embodiments, for example, the hydrocarbon reservoir is an oil sands reservoir. In some embodiments, for example, the hydrocarbon reservoir is disposed subsea.

In one aspect, the process includes:

within the hydrocarbon reservoir, electrically heating a liquid heating fluid such that the liquid heating fluid is evaporated to produce a gaseous heating fluid;

heating hydrocarbon-comprising material with the gaseous heating fluid such that the heated hydrocarbon-comprising material is mobilized and such that the gaseous heating fluid is condensed to produce a condensed heating fluid;

electrically heating at least a fraction of the condensed heating fluid such that the at least a condensed heating fluid fraction is re-evaporated; and while the evaporation, the condensing, and the re-evaporation are being effected, producing a produced fluid including at least the mobilized hydrocarbon-comprising material.

For purposes of enabling ease of reference herein, the above-described process, or any one of the embodiments described below, may be referred to as an "in-situ reflux process".

In some embodiments, for example, the produced fluid may also include some heating fluid.

In some embodiments, for example, a reflux is effected. The reflux includes the evaporation, the condensing and the re-evaporation. While the reflux is being effected, reservoir fluid, including at least a fraction of the mobilized hydrocarbon-comprising material, is produced.

By refluxing the heating fluid within the reservoir, heat losses are avoided, when compared to conducting a heating fluid, such as steam, from the surface and into the reservoir, such as during a steam-assisted gravity drainage ("SAGD) operation. Heat losses are attributable to the production of the condensed heating fluid (i.e. steam condensate) along with the heated and mobilized bitumen through the production well to the surface. The steam condensate is at or near saturated steam temperature as it is produced into the well, and heat losses occur as the produced fluid are conducted from the reservoir to the surface facilities. In the process of separating the oil from the water at the surface, additional heat is lost. In many SAGD operations, the produced water is further cooled to allow for treatment to render it suitable for recycling as boiler feedwater. Thus, if the water is "refluxed" within the reservoir, instead of being produced, the heat losses associated with the production and recycling of produced water are avoided.

In some embodiments, for example, the heating fluid, in its liquid state, may include formation water that is resident within the hydrocarbon reservoir, or may include heating fluid (for example, water) that is injected into the hydrocarbon reservoir and supplied from above the surface, or may include both of the formation water and the injected heating fluid.

In some embodiments, for example, the heating fluid includes water, such that, upon evaporation, steam is produced. The steam is conducted to a surface within the reservoir, and heats hydrocarbon-comprising material that is entrained within the reservoir, thereby effecting mobilization of the hydrocarbon-comprising material, while also effecting the condensation of the steam. In some embodiments, for example, at least some of the condensed steam then drains into a collection reservoir, where it is re-evaporated by an electric heater disposed within the collection reservoir.

In some embodiments, for example, the heating fluid may include any combination of an anti-foaming chemical, a corrosion inhibitor, a scale inhibitor, and solvent material that is soluble in oils. In some embodiments, for example, the solvent material includes at least one hydrocarbon compound, wherein the at least one hydrocarbon compound includes a total number of carbon atoms of between three (3) and ten (10), such as between five (5) and seven (7).

For oil sands formations, and where the heating fluid, in the evaporated state, is steam, or is substantially steam, the cycle of evaporation, condensing and re-evaporation results in the creation of a steam chamber.

In some embodiments, for example, at least a fraction of the reflux is effected by an electric heater that is disposed within the hydrocarbon reservoir. In some embodiments, for example, electric heater includes an electrically resistive heater. In some embodiments, for example, the term "electric heater" covers heaters that effect electromagnetic heating.

In some embodiments, for example, the electric heater is disposed in indirect heat transfer communication with at least a fraction of the condensed heating fluid.

In some embodiments, for example, the electric heater is disposed within a collection reservoir, and the collection reservoir receives reservoir fluid from the reservoir. The reservoir fluid includes the mobilized hydrocarbon-comprising material and condensed heating fluid. In some embodiments, for example, the collected reservoir fluid consists of, or substantially consists of, the mobilized hydrocarbon-comprising material. In this respect, the collected reservoir fluid, consisting of, or substantially consisting of, the mobilized hydrocarbon-comprising material, is disposed in heat transfer fluid communication with the condensed heating fluid. In this respect, upon heating by the electric heater, the collected reservoir fluid concomitantly effects the transfer of such heat imparted by the electric heater to the condensed heating fluid, thereby effecting evaporation of the condensed heating fluid.

Referring to FIG. 1, in some embodiments, for example, in-situ reflux is effected with a single well 102. In this respect, a is provided for effecting in-situ reflux, and includes the well 102 which is used for both production of the produced fluid as well as for effecting the entirety of the reflux of the heating fluid that is effecting mobilization of the produced hydrocarbon-comprising material 118 (i.e. a second well is not being used to contain an electric heater to effect refluxing).

The produced fluid is produced through the production well 102. In some embodiments, for example, production is effected by artificial lift, such as by a downhole pump and/or by gas lift.

The production well 102 extends into the hydrocarbon reservoir 1000 from the surface. The production well 102 includes a collection reservoir 108 for collecting reservoir fluids. The reservoir fluids include mobilized hydrocarbon-comprising material and condensed heating fluid. In some embodiments, for example, the reservoir fluid being collected within the production well consists of, or substantially consists of, mobilized hydrocarbon-comprising material, and such collected reservoir fluid 110 may be in heat transfer communication with the condensed heating fluid. In some embodiments, for example, the collected reservoir fluid 110 may include the mobilized hydrocarbon-comprising material and condensed heating fluid.

An electric heater 104 is disposed within the production well 102 and, more specifically, within the collection reservoir 108 of the production well 102. The collection reservoir includes reservoir fluid that has collected therein. As mentioned above, the reservoir fluid includes mobilized hydrocarbon-comprising material, and may also include condensed heating fluid.

The electric heater 104 is configured for effecting heating of the collected reservoir fluid 110. In some embodiments, for example, the electric heater is disposed in direct heat transfer communication with the collected reservoir fluid. Heating of any condensed heating fluid, whether disposed as part of the collected reservoir fluid, or disposed in heat transfer communication with the collected reservoir fluid, externally of the production well 102, is, therefore, effected by the electric heater, when the electric heater is heating the collected reservoir fluid.

Figure 8:
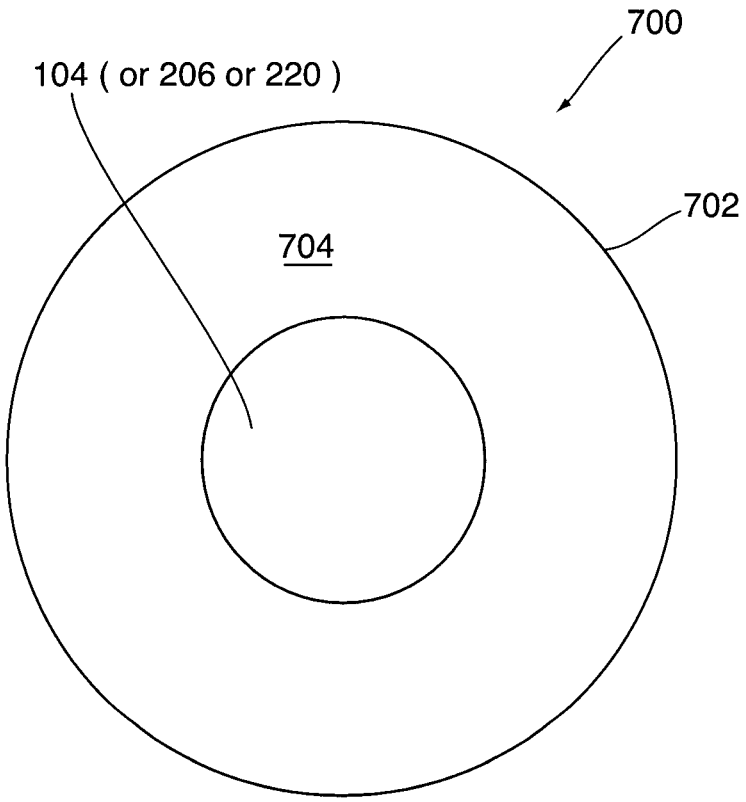
FIG. 8 is a sectional elevation view of a heating assembly of an embodiment of a system used to implement the in-situ reflux process.

Referring to FIG. 8, in some embodiments, for example, the electric heater 104 is part of a heating assembly 700, such that the electric heater is in indirect heat transfer communication with the reservoir fluid via a liquid heat transfer medium 704. An example of a suitable liquid heat transfer medium 704 is glycerin. In this respect, a heating assembly 700 is provided, and includes a housing 702, the electric heater, and the liquid heat transfer medium 704. The electric heater is disposed within a housing 702, with the space between the electric heater and the housing 702 being occupied with the liquid heat transfer medium 704. The liquid heat transfer medium 704 has a higher boiling point than that of the heating fluid at the pressure of the hydrocarbon reservoir portion from which the mobilized hydrocarbon-comprising material is being produced, such as by at least 50 degrees Celsius, such as, for example, by at least 100 degrees Celsius. The collection reservoir 108 is defined by a space within the production well 102, between the housing 702 and the casing of the production well. Because the heater assembly is disposed within the collection reservoir, the liquid heat transfer medium 704 is disposed in heat transfer communication with the collected reservoir fluid, through the wall of the housing 702. In this respect, heat is transferred from the electric heater to the collected reservoir fluid via the liquid heat transfer medium 704 and through the wall of the housing 702. By virtue of this configuration, any evaporated heating fluid may become disposed at a relatively higher temperature, owing to the fact that the liquid heat transfer medium 704 can be heated to higher temperatures by the electric heater, and transfer this higher quality heat to the reservoir fluids (and, therefore, to the condensed heating fluid), versus direct heating of the reservoir fluids by the electric heater (without any intervening liquid heat transfer medium 704). This also facilitates production of a "drier" hydrocarbon material.

In some embodiments, for example, the electric heater 104 is disposed within a laterally extending section 102*a* of the production well 102, that extends from a vertically extending section 102*b*, at the heel 102*c* of the production well 102. In some embodiments, for example, the laterally extending section 102*a* is disposed along a horizontal, or substantially horizontal, axis.

In some embodiments, for example, the electric heater 104 includes a plurality of heater segments, and each one of the heater segments may be controllable independently from the other heater segments in terms of the rate of energy being produced. By providing a plurality of heater segments that are independently controllable, improved control of heating fluid conformance is made possible.

In some embodiments, for example, the electrical heating of the collected reservoir fluid 110 is such that the temperature of the collected reservoir fluid is greater than or equal to at least the boiling point of the liquid heating fluid at the pressure of the hydrocarbon reservoir portion from which the mobilized hydrocarbon-comprising material is being produced. In this respect, both of (i) evaporation of the heating fluid that is disposed in heat transfer communication with the collected reservoir fluid, but externally of the collection reservoir 108, and (ii) evaporation of any heating fluid that is present within the collected reservoir fluid, is promoted, so as to return the heating fluid to the reservoir for effecting mobilization of the hydrocarbon-comprising material within the reservoir 1000, and thereby contribute to the refluxing. As well, by promoting the evaporation, the produced fluid 118 that is being produced contains less heating fluid, thereby reducing energy requirements to transport the produced fluid to the surface 1002 (as there is less fluid volume to produce), and also reducing demands on separation processes for removal of heating fluid from the produced fluids.

In some embodiments, for example, the electrical heating of the collected reservoir fluid 110 is effected in response to sensing of a temperature, of the collected reservoir fluid, that is at or below a predetermined temperature that is based upon the boiling point of the liquid heating fluid at the pressure of the hydrocarbon reservoir portion from which the mobilized hydrocarbon-comprising material is being produced. In some embodiments, prior to the electrical heating of the collected reservoir fluid, a temperature of the collected reservoir fluid is sensed that is at or below a predetermined temperature that is based upon the boiling point of the liquid heating fluid at the pressure of the hydrocarbon reservoir portion from which the mobilized hydrocarbon-comprising material is being produced. In some embodiments, for example, the predetermined temperature is at or above the boiling point of the liquid heating fluid at the pressure of the hydrocarbon reservoir portion from which the mobilized hydrocarbon-comprising material is being produced. The purpose of having the predetermined temperature being at the boiling point of the liquid heating fluid at the pressure of the hydrocarbon reservoir portion from which the mobilized hydrocarbon-comprising material is being produced, is for evaporating liquid heating fluid that has collected within the well. Liquid heating fluid that has collected within the well would be disposed at or below the boiling point of the liquid heating fluid at the pressure of the hydrocarbon reservoir portion from which the mobilized hydrocarbon-comprising material is being produced (where the heating fluid, in the liquid state, is water, this would be the saturated steam temperature within the reservoir). By effecting electrical heating while the collected reservoir fluid is disposed at or below the boiling point of the liquid heating fluid at the pressure of the hydrocarbon reservoir portion from which the mobilized hydrocarbon-comprising material is being produced, the intention is to vaporize the liquid heating fluid that has collected within the well as part of the collected reservoir fluid. In some embodiments, for example, it may be intended to vaporize the heating fluid that is disposed externally of the well 102, in which case the predetermined temperature may be above the boiling point of the liquid heating fluid at the pressure of the hydrocarbon reservoir portion from which the mobilized hydrocarbon-comprising material is being produced, for purposes of precluding collection of the heating fluid within the well 102.

In some embodiments, for example, the production well 102 includes the heel 102*c*. In this respect, the electrical heating of the collected reservoir fluid by the electric heater 104 is such that the temperature of the collected reservoir fluid, disposed at the heel 102*c* of the production well 102, is greater than or equal to the boiling point of the liquid heating fluid at the pressure of the hydrocarbon reservoir portion from which the mobilized hydrocarbon-comprising material is being produced. Similar to the above, both of (i) evaporation of the heating fluid that is disposed in heat transfer communication with the collected reservoir fluid, but externally of the collection reservoir, and (ii) evaporation of any heating fluid that is present within the collected reservoir fluid, is promoted, so as to return the heating fluid to the reservoir for effecting mobilization of the hydrocarbon-comprising material within the reservoir, and thereby contribute to the refluxing. As well, by promoting the evaporation, the produced fluid that is being produced contains less heating fluid, thereby reducing energy requirements to transport the produced fluid to the surface (as there is less fluid volume to produce), and also reducing demands on separation processes for removal of heating fluid from the produced fluids.

In some embodiments, for example, the electrical heating of the collected reservoir fluid 110 by the electric heater 104 is effected in response to sensing of a temperature, of the collected reservoir fluid 110 disposed at the heel 102*c* of the production well 102, that is at or below a predetermined temperature that is based upon the boiling point of the liquid heating fluid at the pressure of the hydrocarbon reservoir portion from which the mobilized hydrocarbon-comprising material is being produced. In some embodiments, for example, prior to the electrical heating of the collected reservoir fluid 110 by the electric heater 104, a temperature, of the collected reservoir fluid that is disposed at the heel 102*c* of the production well 102, is sensed that is at or below a predetermined temperature that is based upon the boiling point of the liquid heating fluid at the pressure of the hydrocarbon reservoir portion from which the mobilized hydrocarbon-comprising material is being produced. In some embodiments, for example, the predetermined temperature is at or above the boiling point of the liquid heating fluid at the pressure of the hydrocarbon reservoir portion from which the mobilized hydrocarbon-comprising material is being produced. The purpose of having the predetermined temperature being at the boiling point of the liquid heating fluid at the pressure of the hydrocarbon reservoir portion from which the mobilized hydrocarbon-comprising material is being produced, is for evaporating liquid heating fluid that has collected within the well. Liquid heating fluid that has collected within the well would be disposed at or below the boiling point of the liquid heating fluid at the pressure of the hydrocarbon reservoir portion from which the mobilized hydrocarbon-comprising material is being produced (where the heating fluid, in the liquid state, is water, this would be the saturated steam temperature within the reservoir). By effecting electrical heating while the collected reservoir fluid is disposed at or below the boiling point of the liquid heating fluid at the pressure of the hydrocarbon reservoir portion from which the mobilized hydrocarbon-comprising material is being produced, the intention is to vaporize the liquid heating fluid that has collected within the well as part of the collected reservoir fluid. In some embodiments, for example, it may be intended to vaporize the heating fluid that is disposed externally of the well, in which case the predetermined temperature may be above the boiling point of the liquid heating fluid at the pressure of the hydrocarbon reservoir portion from which the mobilized hydrocarbon-comprising material is being produced, for purposes of precluding collection of the heating fluid within the well.

As discussed above, in some embodiments, for example, the collected reservoir fluid 110 consists of, or substantially consists of, the mobilized hydrocarbon-comprising material. In those embodiments where the electric heater 104 is disposed in direct heat transfer communication with the collected reservoir fluid, by having the collected reservoir fluid consisting of, or substantially consisting of, the mobilized hydrocarbon-comprising material, evaporation of condensed heating fluid disposed in heat transfer communication with the collected reservoir fluid, may produce evaporated heating fluid having a relatively higher temperature, owing to the fact that the mobilized hydrocarbon-comprising material can be heated to higher temperatures by the electric heater, and transfer this higher quality heat to any condensed heating fluid disposed in heat transfer communication with the collected reservoir fluid, versus direct heating of the condensed heating fluid by the electric heater (without any intervening liquid heat transfer medium 704).

Also, by having the collected reservoir fluid 110 consist of, or substantially consist of, mobilized hydrocarbon-comprising material, scale formation within the production well 102 may be mitigated. Where the heating fluid, in its liquid state, includes water, it is preferable that water does not become disposed in contact structures within the production well, including the electric heater 104, as evaporation of water in this context may result in precipitation of dissolved scale-forming solids within the production well 102, including onto the electric heater or other structures, resulting in scale formation. Accordingly, in such embodiments, by ensuring that the collected reservoir fluid consists of, or substantially consists of, mobilized hydrocarbon-comprising material, the collected heating fluid is fluidically isolated, or substantially fluidically isolated, from the production well, thereby mitigating potential scale formation within the production well (including scale formation on the second electric heater).

Further, as a necessary incident, by having the collected reservoir fluid 110 consist of, or substantially consist of, mobilized hydrocarbon-comprising material, production of a "drier" hydrocarbon material is facilitated. This reduces energy requirements to transport the produced fluid to the surface (as there is less fluid volume to produce) and also reduces demands on separation processes for removal of heating fluid from the produced fluids.

In this respect, in some embodiments, for example, the rate of heating of the collected reservoir fluid 110 by the electric heater 104 is modulated such that the collected reservoir fluid consists of, or substantially consists of, the mobilized hydrocarbon-comprising material.

In some embodiments, for example, the composition of the collected reservoir fluid 110 may be sensed by a densitometer. In this respect, the rate of heating effected by the electric heater 104 may be modulated based on sensing of the density of the collected reservoir fluid by the densitometer. In response to sensing of a density of the collected reservoir fluid that is characteristic of a collected reservoir fluid having excessive non-hydrocarbon-comprising fluid (such as the heating fluid), the rate of heating by the electric heater may be increased to effect evaporation of the fluid. This will promote the maintenance of a collected reservoir fluid that consists of hydrocarbon-comprising material, or substantially hydrocarbon-comprising material. This promotes reflux of the condensed heating fluid (as above-described), higher quality heat transfer to effect the evaporation of the condensed heating fluid, mitigates scale formation, and production of "drier" hydrocarbon-comprising material.

In some embodiments, for example, the electric heater 104 is submerged within the collected reservoir fluid 110 (consisting of hydrocarbon-comprising material, or substantially hydrocarbon-comprising material), and the producing is modulated such that sufficient collected reservoir fluid is maintained within the production well 102 such that the electric heater is submerged within collected reservoir fluid.

In some embodiments, for example, the laterally, or substantially laterally, extending section 102*a* of the production well 102 is co-operatively configured with the electric heater 104 such that while the reservoir fluid is being conducted towards the well 102, the laterally, or substantially laterally, extending section 102*a* of the production well 102 is disposed to receive and collect the reservoir fluid across (but not necessarily continuously across) an operative portion of the laterally, or substantially laterally, extending section of the production well 102, and the length of the operative portion, measured along the axis of the operative portion, is at least 1000 meters. Because the heating fluid is not supplied from the surface, heat losses, associated with longer wells, is not concerning, as it is for SAGD operations. Also, because the volumetric flow of produced fluid is relatively less than for SAGD production, hydraulic pressure losses are also not a material factor for well design. In combination, this enables the use of longer wells in in situ-reflux operations to effect production of hydrocarbon-comprising material, although shorter wells (i.e. those less than 1000 meters) could also be used.

In some embodiments, for example, the vertically, or substantially vertically, extending section 102*b* of the production well 102 has a length, measured along the axis of the vertically, or substantially vertically, extending section, of at least 1000 meters, so as to allow for production from deeper resources. Again, heat losses and hydraulic pressure losses, with in-situ reflux are not concerning, as it is for SAGD operations, and it is, possible to, therefore, use longer wells, although shorter wells (i.e. those less than 1000 meters in depth) could also be used.

In some embodiments, for example, heating fluid may be lost to the reservoir 1000, and make-up heating fluid may be required. In this respect, while the heating of a liquid heating fluid is being effected, supplemental liquid heating fluid 116 may be supplied from a source disposed above the surface 1002. In this respect, the liquid heating fluid includes the supplemental liquid heating fluid 116. In some embodiments, for example, the supplying of supplemental liquid heating fluid 116 is effected via an injector string 114 disposed within the production well 102. In some embodiments, for example, the injector string includes a "spaghetti string". In some embodiments, for example, the supplying of the supplemental liquid heating fluid is effected in response to sensing of a pressure, within the hydrocarbon reservoir portion from which the mobilized hydrocarbon-comprising material is being produced, that is less than a predetermined pressure. The predetermined pressure is based on, amongst other things, the desirability of operating at higher pressures in order to provide a greater driving force for production, balanced versus the recognition that heat transfer efficiency is more efficient at lower pressures and that cap rock integrity may limit the maximum possible operating pressure.

In operation, evaporation of the heating fluid is effected by the heat generated by the electric heater 104. The evaporated heating fluid is conducted to the hydrocarbon reservoir and transfers heat energy to the hydrocarbon-comprising material such that the hydrocarbon-comprising material is mobilized and the heating fluid is condensed. Reservoir fluid 110 enters the production well 102 via ports 106, collects within the collection reservoir 108 and is electrically heated by the electric heater 104 (either directly or via the heater assembly 106). Heating is controlled such that the reservoir fluid is primarily collected mobilized hydrocarbon-comprising material. The heated reservoir fluid transfer heat to condensed heating fluid that is disposed in heat transfer communication with the reservoir fluid, thereby effect re-evaporation of the condensed heating fluid, and thereby effect the reflux 112. After a period of time, an evaporated heat fluid chamber develops (where the heating fluid, in the liquid state, is water, then a steam chamber would be developed). In parallel, reservoir fluid collected within the production well 104 is continuously produced, such as by a downhole pump and/or artificial lift, or by reservoir pressure.

Figure 2:
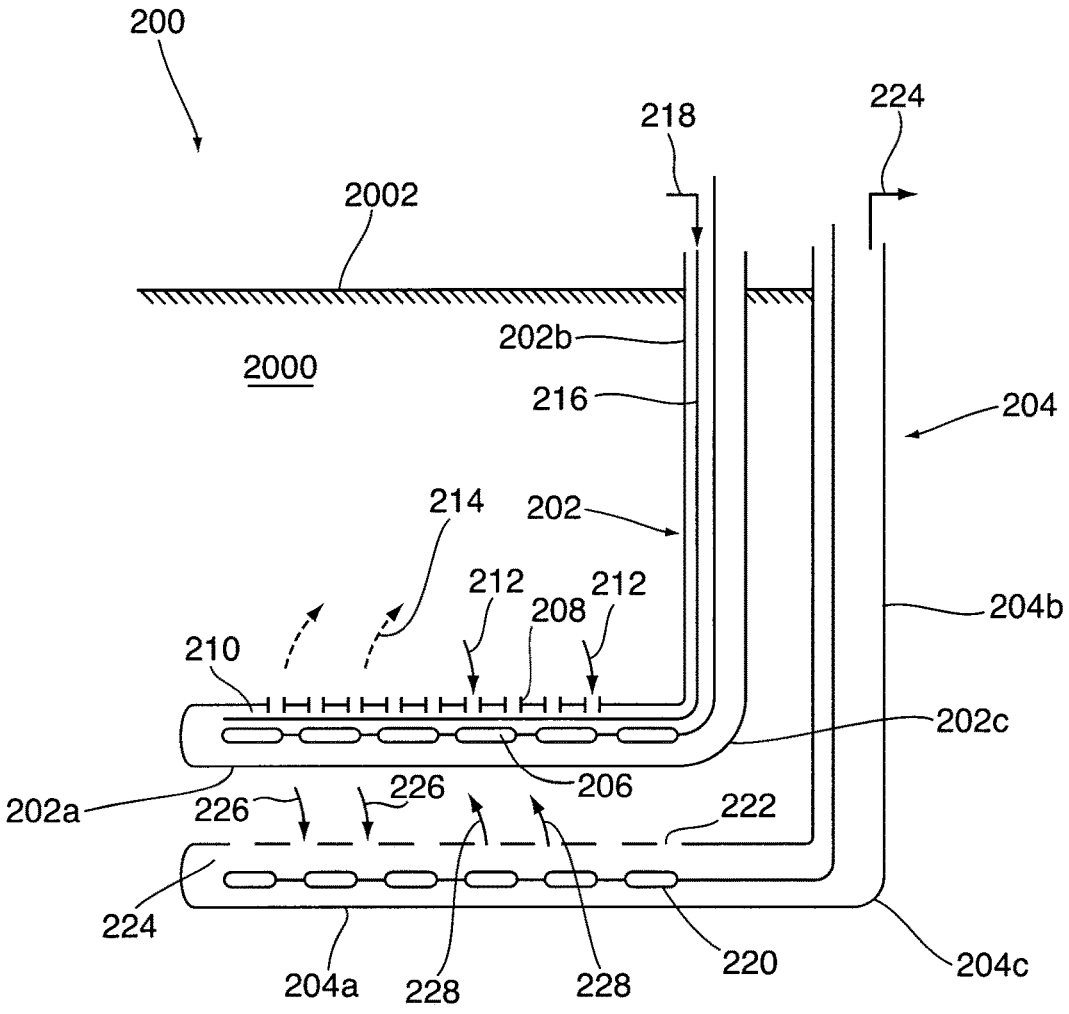
FIG. 2 is a schematic illustration of an embodiment of a system, with a non-production well and a production well, used to implement the in-situ reflux process.

Referring to FIG. 2, in some embodiments, for example, in-situ reflux may be effected by a system 200 including a non-production well 202 and a production well 204. A first electric heater 206 is disposed within the non-production well 202. At least a fraction of the reflux is effected by a first electric heater 206. The producing of the produced fluid 224 is effected via the production well 204. The production well 204 is disposed below the non-production well 202. The non-production well 202 does not produce produced fluid 224. The non-production well is provided for, amongst other things, to effect reflux of the heating fluid. In comparison to the embodiment illustrated in FIG. 1, this configuration may enable recovery and production of hydrocarbon-comprising material that is disposed closer to the bottom of the hydrocarbon reservoir, with less energy losses to the formation below the hydrocarbon reservoir without any hydrocarbon reserves.

The non-production well 202 extends into the hydrocarbon reservoir 2000 from the surface. In some embodiments, for example, the first electric heater 206 is disposed within a laterally extending section 202*a* of the non-production well 202, that extends from a vertically extending section 202*b*, at the heel 202*c* of the non-production well 202. In some embodiments, for example, the laterally extending section 202*a* is disposed along a horizontal, or substantially horizontal, axis.

In some embodiments, for example, the first electric heater 206 is disposed within the collection reservoir 210 of the non-production well 202. The collection reservoir 210 includes reservoir fluid 212 that has collected therein. In some embodiments, for example, the collected reservoir fluids 212 consists of, or substantially consists of, the mobilized hydrocarbon-comprising material, and the collected mobilized hydrocarbon-comprising material is disposed in heat transfer communication with at least a fraction of the condensed heating fluid. In some embodiments, for example, the collected reservoir fluid may also include the condensed heating fluid.

The first electric heater 206 is configured for effecting heating of the collected reservoir fluid 212. In some embodiments, for example, the first electric heater is disposed in direct heat transfer communication with the collected reservoir fluid. Heating of any condensed heating fluid, whether disposed as part of the collected reservoir fluid, or disposed in heat transfer communication with the collected reservoir fluid, externally of the production well, is, therefore, effected by the first electric heater, when the first electric heater is heating the collected reservoir fluid.

Referring to FIG. 8, in some embodiments, for example, the first electric heater 206 is part of a heating assembly 700, such that the electric heater is in indirect heat transfer communication with the collected reservoir fluid via a liquid heat transfer medium 704. An example of a suitable liquid heat transfer medium 704 is glycerin. In this respect, a heating assembly 700 is provided, and includes a housing 702, the electric heater, and the liquid heat transfer medium 704. The electric heater is disposed within a housing 702, with the space between the electric heater and the housing 702 being occupied with the liquid heat transfer medium 704. The liquid heat transfer medium 704 has a higher boiling point than that of the heating fluid at the pressure of the hydrocarbon reservoir portion from which the mobilized hydrocarbon-comprising material is being produced, such as by at least 50 degrees Celsius, such as, for example, by at least 100 degrees Celsius. The collection reservoir 210 is defined by a space within the non-production well 202, between the housing 702 and the casing of the non-production well 202. Because the heater assembly is disposed within the collection reservoir, the liquid heat transfer medium 704 is disposed in heat transfer communication with the collected reservoir fluid 212, through the wall of the housing 702. In this respect, heat is transferred from the first electric heater to the collected reservoir fluid via the liquid heat transfer medium 704 and through the wall of the housing 702. By virtue of this configuration, any evaporated heating fluid may become disposed at a relatively higher temperature, owing to the fact that the liquid heat transfer medium 704 can be heated to higher temperatures by the first electric heater, and transfer this higher quality heat to the reservoir fluids (and, therefore, to the condensed heating fluid), versus direct heating of the reservoir fluids by the first electric heater (without any intervening liquid heat transfer medium 704).

In some embodiments, for example, the first electric heater 206 is disposed within a laterally extending section 202*a* of the non-production well 202, that extends from a vertically extending section 202*b*, at the heel 202*c* of the non-production well 202. In some embodiments, for example, the laterally extending section 202*a* is disposed along a horizontal, or substantially horizontal, axis.

In some embodiments, for example, the first electric heater 206 includes a plurality of heater segments, and each one of the heater segments may be controllable independently from the other heater segments in terms of the rate of energy being produced. By providing a plurality of heater segments that are independently controllable, improved control of heating fluid conformance is made possible.

In some embodiments, for example, the electrical heating of the collected reservoir fluid 212 is such that the temperature of the collected reservoir fluid is greater than or equal to at least the boiling point of the liquid heating fluid at the pressure of the hydrocarbon reservoir portion from which the mobilized hydrocarbon-comprising material is being produced. In this respect, both of (i) evaporation of the heating fluid that is disposed in heat transfer communication with the collected reservoir fluid, but externally of the collection reservoir 210, and (ii) evaporation of any heating fluid that is present within the collected reservoir fluid, is promoted, so as to return the heating fluid to the reservoir for effecting mobilization of the hydrocarbon-comprising material within the reservoir 2000, and thereby contribute to the refluxing.

In some embodiments, for example, the electrical heating of the collected reservoir fluid 212 is effected in response to sensing of a temperature, of the collected reservoir fluid, that is at or below a predetermined temperature that is based upon the boiling point of the liquid heating fluid at the pressure of the hydrocarbon reservoir portion from which the mobilized hydrocarbon-comprising material is being produced. In some embodiments, prior to the electrical heating of the collected reservoir fluid, a temperature of the collected reservoir fluid is sensed that is at or below a predetermined temperature that is based upon the boiling point of the liquid heating fluid at the pressure of the hydrocarbon reservoir portion from which the mobilized hydrocarbon-comprising material is being produced. In some embodiments, for example, the predetermined temperature is at or above the boiling point of the liquid heating fluid at the pressure of the hydrocarbon reservoir portion from which the mobilized hydrocarbon-comprising material is being produced. The purpose of having the predetermined temperature being at the boiling point of the liquid heating fluid at the pressure of the hydrocarbon reservoir portion from which the mobilized hydrocarbon-comprising material is being produced, is for evaporating liquid heating fluid that has collected within the well. Liquid heating fluid that has collected within the well would be disposed at or below the boiling point of the liquid heating fluid at the pressure of the hydrocarbon reservoir portion from which the mobilized hydrocarbon-comprising material is being produced (where the heating fluid, in the liquid state, is water, this would be the saturated steam temperature within the reservoir). By effecting electrical heating while the collected reservoir fluid is disposed at or below the boiling point of the liquid heating fluid at the pressure of the hydrocarbon reservoir portion from which the mobilized hydrocarbon-comprising material is being produced, the intention is to vaporize the liquid heating fluid that has collected within the well as part of the collected reservoir fluid. In some embodiments, for example, it may be intended to vaporize the heating fluid that is disposed externally of the well, in which case the predetermined temperature may be above the boiling point of the liquid heating fluid at the pressure of the hydrocarbon reservoir portion from which the mobilized hydrocarbon-comprising material is being produced, for purposes of precluding collection of the heating fluid within the well.

In some embodiments, for example, the non-production well 202 includes the heel 202*c*. In this respect, the electrical heating of the collected reservoir fluid by the electric heater 206 is such that the temperature of the collected reservoir fluid, disposed at the heel 202*c* of the non-production well 202, is greater than or equal to the boiling point of the liquid heating fluid at the pressure of the hydrocarbon reservoir portion from which the mobilized hydrocarbon-comprising material is being produced. Similar to the above, both of (i) evaporation of the heating fluid that is disposed in heat transfer communication with the collected reservoir fluid, but externally of the collection reservoir, and (ii) evaporation of any heating fluid that is present within the collected reservoir fluid, is promoted, so as to return the heating fluid to the reservoir for effecting mobilization of the hydrocarbon-comprising material within the reservoir, and thereby contribute to the refluxing.

In some embodiments, for example, the electrical heating of the collected reservoir fluid by the first electric heater 206 is effected in response to sensing of a temperature, of the collected reservoir fluid disposed at the heel 202*c* of the non-production well 202, that is at or below a predetermined temperature that is based upon the boiling point of the liquid heating fluid at the pressure of the hydrocarbon reservoir portion from which the mobilized hydrocarbon-comprising material is being produced. In some embodiments, for example, prior to the electrical heating of the collected reservoir fluid by the first electric heater 206, a temperature, of the collected reservoir fluid that is disposed at the heel 202*c* of the non-production well 202, is sensed that is at or below a predetermined temperature that is based upon the boiling point of the liquid heating fluid at the pressure of the hydrocarbon reservoir portion from which the mobilized hydrocarbon-comprising material is being produced. In some embodiments, for example, the predetermined temperature is at or above the boiling point of the liquid heating fluid at the pressure of the hydrocarbon reservoir portion from which the mobilized hydrocarbon-comprising material is being produced. The purpose of having the predetermined temperature being at the boiling point of the liquid heating fluid at the pressure of the hydrocarbon reservoir portion from which the mobilized hydrocarbon-comprising material is being produced, is for evaporating liquid heating fluid that has collected within the well. Liquid heating fluid that has collected within the well would be disposed at or below the boiling point of the liquid heating fluid at the pressure of the hydrocarbon reservoir portion from which the mobilized hydrocarbon-comprising material is being produced (where the heating fluid, in the liquid state, is water, this would be the saturated steam temperature within the reservoir). By effecting electrical heating while the collected reservoir fluid is disposed at or below the boiling point of the liquid heating fluid at the pressure of the hydrocarbon reservoir portion from which the mobilized hydrocarbon-comprising material is being produced, the intention is to vaporize the liquid heating fluid that has collected within the well as part of the collected reservoir fluid. In some embodiments, for example, it may be intended to vaporize the heating fluid that is disposed externally of the well, in which case the predetermined temperature may be above the boiling point of the liquid heating fluid at the pressure of the hydrocarbon reservoir portion from which the mobilized hydrocarbon-comprising material is being produced, for purposes of precluding collection of the heating fluid within the well.

As discussed above, in some embodiments, for example, the collected reservoir fluid 212 consists of, or substantially consists of, the mobilized hydrocarbon-comprising material. In those embodiments where the first electric heater is disposed in direct heat transfer communication with the collected reservoir fluid, by having the collected reservoir fluid consisting of, or substantially consisting of, the mobilized hydrocarbon-comprising material, evaporation of condensed heating fluid disposed in heat transfer communication with the collected reservoir fluid, may produce evaporated heating fluid having a relatively higher temperature, owing to the fact that the mobilized hydrocarbon-comprising material can be heated to higher temperatures by the first electric heater 206, and transfer this higher quality heat to any condensed heating fluid disposed in heat transfer communication with the collected reservoir fluid, versus direct heating of the condensed heating fluid by the first electric heater (without any intervening liquid heat transfer medium 704).

Also, by having the collected reservoir fluid 212 consist of, or substantially consist of, mobilized hydrocarbon-comprising material, scale formation within the non-production well 202 may be mitigated. Where the heating fluid, in its liquid state, includes water, it is preferable that water does not become disposed with structures within the non-production well 202, including the first electric heater 206, as evaporation of water in this context may result in precipitation of dissolved scale-forming solids within the non-production well, including onto the first electric heater or other structures, resulting in scale formation. Accordingly, in such embodiments, by ensuring that the collected reservoir fluid consists of, or substantially consists of, mobilized hydrocarbon-comprising material, the collected heating fluid is fluidically isolated, or substantially fluidically isolated, from the non-production well, thereby mitigating potential scale formation within the non-production well (including scale formation on the second electric heater).

In this respect, in some embodiments, for example, the rate of heating of the collected reservoir fluid 212 by the first electric heater 206 is modulated such that the collected reservoir fluid consists of, or substantially consists of, the mobilized hydrocarbon-comprising material.

In some embodiments, for example, the composition of the collected reservoir fluid 212 may be sensed by a densitometer. In this respect, the rate of heating effected by the first electric heater 206 may be modulated based on sensing of the density of the collected reservoir fluid by the densitometer. In response to sensing of a density of the collected reservoir fluid that is characteristic of a collected reservoir fluid having excessive non-hydrocarbon-comprising fluid (such as the heating fluid), the rate of heating by the second electric heater may be increased to effect evaporation of the fluid. This will promote the maintenance of a collected reservoir fluid that consists of hydrocarbon-comprising material, or substantially hydrocarbon-comprising material. Amongst other things, this promotes reflux of the condensed heating fluid (as above-described), higher quality heat transfer to effect the evaporation of the condensed heating fluid, and mitigates scale formation.

The produced fluid 224 is produced through the production well 204. In some embodiments, for example, production is effected by artificial lift, such as by a downhole pump and/or by gas lift.

The production well 204 extends into the hydrocarbon reservoir from the surface. The production well 204 includes a collection reservoir 224 for collecting reservoir fluids 226. The reservoir fluids include mobilized hydrocarbon-comprising material and condensed heating fluid. In some embodiments, for example, the reservoir fluid being collected within the production well consists of, or substantially consists of, mobilized hydrocarbon-comprising material, and such collected reservoir fluid may be in heat transfer communication with condensed heating fluid that has bypassed the non-production well 202. In some embodiments, for example, the collected reservoir fluid may include the mobilized hydrocarbon-comprising material and condensed heating fluid that has bypassed the non-production well 202. The condensed heating fluids are more likely to be disposed in such relationships with the collected reservoir fluid in later-stage in-situ reflux processes being practised within oil sands. In more mature operations, the steam chamber tends to laterally grow, resulting in condensed heating fluid bypassing the non-production well 202 while draining within the reservoir.

In some embodiments, for example, it may be desirable to remove condensed heating fluid from the reservoir fluid 224 being collected within the production well 204, prior to production of the reservoir fluid, as well as to reflux such condensed heating fluid that has bypassed the non-production well 202.

In this respect, a second electric heater 220 is disposed within the production well and, more specifically, within the collection reservoir 224 of the production well 204. The collection reservoir includes reservoir fluid that has collected therein.

The second electric heater 220 is configured for effecting heating of the collected reservoir fluid 226. In some embodiments, for example, the second electric heater is disposed in direct heat transfer communication with the collected reservoir fluid. Heating of any condensed heating fluid, whether disposed as part of the collected reservoir fluid, or disposed in heat transfer communication with the collected reservoir fluid, externally of the production well 204, is, therefore, effected by the second electric heater, when the second electric heater is heating the collected reservoir fluid.

Referring to FIG. 8, in some embodiments, for example, the second electric heater 220 is part of a heating assembly 700, such that the second electric heater is in indirect heat transfer communication with the collected reservoir fluid 226 via a liquid heat transfer medium 704. An example of a suitable liquid heat transfer medium 704 is glycerin. In this respect, a heating assembly 700 is provided, and includes a housing 702, second the electric heater, and the liquid heat transfer medium 704. The second electric heater is disposed within a housing 702, with the space between the second electric heater and the housing 702 being occupied with the liquid heat transfer medium 704. The liquid heat transfer medium 704 has a higher boiling point than that of the heating fluid at the pressure of the hydrocarbon reservoir portion from which the mobilized hydrocarbon-comprising material is being produced, such as by at least 50 degrees Celsius, such as, for example, by at least 100 degrees Celsius. The collection reservoir 224 is defined by a space within the production well, between the housing 702 and the casing of the production well 204. Because the heater assembly is disposed within the collection reservoir, the liquid heat transfer medium 704 is disposed in heat transfer communication with the collected reservoir fluid, through the wall of the housing 702. In this respect, heat is transferred from the second electric heater to the collected reservoir fluid via the liquid heat transfer medium 704 and through the wall of the housing 702. By virtue of this configuration, any evaporated heating fluid may become disposed at a relatively higher temperature, owing to the fact that the liquid heat transfer medium 704 can be heated to higher temperatures by the second electric heater, and transfer this higher quality heat to the reservoir fluids (and, therefore, to the condensed heating fluid), versus direct heating of the reservoir fluids by the second electric heater (without any intervening liquid heat transfer medium 704). This also facilitates production of a "drier" hydrocarbon material.

In some embodiments, for example, the second electric heater 220 is disposed within a laterally extending section 204*a* of the production well 204, that extends from a vertically extending section 204*b*, at the heel 204*c* of the production well 204. In some embodiments, for example, the laterally extending section 204*a* is disposed along a horizontal, or substantially horizontal, axis.

In some embodiments, for example, the second electric heater 220 includes a plurality of heater segments, and each one of the heater segments may be controllable independently from the other heater segments in terms of the rate of energy being produced. By providing a plurality of heater segments that are independently controllable, improved control of heating fluid conformance is made possible.

In some embodiments, for example, the electrical heating of the collected reservoir fluid 226 is such that the temperature of the collected reservoir fluid is greater than or equal to at least the boiling point of the liquid heating fluid at the pressure of the hydrocarbon reservoir portion from which the mobilized hydrocarbon-comprising material is being produced. In this respect, both of (i) evaporation of the heating fluid that is disposed in heat transfer communication with the collected reservoir fluid, but externally of the collection reservoir, and (ii) evaporation of any heating fluid that is present within the collected reservoir fluid, is promoted, so as to return the heating fluid to the reservoir for effecting mobilization of the hydrocarbon-comprising material within the reservoir, and thereby contribute to the refluxing. As well, by promoting the evaporation, the produced fluid 224 that is being produced contains less heating fluid, thereby reducing energy requirements to transport the produced fluid to the surface (as there is less fluid volume to produce), and also reducing demands on separation processes for removal of heating fluid from the produced fluids.

In some embodiments, for example, the electrical heating of the collected reservoir fluid 226 is effected in response to sensing of a temperature, of the collected reservoir fluid, that is at or below a predetermined temperature that is based upon the boiling point of the liquid heating fluid at the pressure of the hydrocarbon reservoir portion from which the mobilized hydrocarbon-comprising material is being produced. In some embodiments, prior to the electrical heating of the collected reservoir fluid, a temperature of the collected reservoir fluid is sensed that is at or below a predetermined temperature that is based upon the boiling point of the liquid heating fluid at the pressure of the hydrocarbon reservoir portion from which the mobilized hydrocarbon-comprising material is being produced. In some embodiments, for example, the predetermined temperature is at or above the boiling point of the liquid heating fluid at the pressure of the hydrocarbon reservoir portion from which the mobilized hydrocarbon-comprising material is being produced. The purpose of having the predetermined temperature being at the boiling point of the liquid heating fluid at the pressure of the hydrocarbon reservoir portion from which the mobilized hydrocarbon-comprising material is being produced, is for evaporating liquid heating fluid that has collected within the well. Liquid heating fluid that has collected within the well would be disposed at or below the boiling point of the liquid heating fluid at the pressure of the hydrocarbon reservoir portion from which the mobilized hydrocarbon-comprising material is being produced (where the heating fluid, in the liquid state, is water, this would be the saturated steam temperature within the reservoir). By effecting electrical heating while the collected reservoir fluid is disposed at or below the boiling point of the liquid heating fluid at the pressure of the hydrocarbon reservoir portion from which the mobilized hydrocarbon-comprising material is being produced, the intention is to vaporize the liquid heating fluid that has collected within the well as part of the collected reservoir fluid. In some embodiments, for example, it may be intended to vaporize the heating fluid that is disposed externally of the well, in which case the predetermined temperature may be above the boiling point of the liquid heating fluid at the pressure of the hydrocarbon reservoir portion from which the mobilized hydrocarbon-comprising material is being produced, for purposes of precluding collection of the heating fluid within the well.

In some embodiments, for example, the production well 204 includes the heel 204*c*. In this respect, the electrical heating of the collected reservoir fluid 226 by the second electric heater 220 is such that the temperature of the collected reservoir fluid, disposed at the heel 204*c* of the production well 204, is greater than or equal to the boiling point of the liquid heating fluid at the pressure of the hydrocarbon reservoir portion from which the mobilized hydrocarbon-comprising material is being produced. Similar to the above, both of (i) evaporation of the heating fluid that is disposed in heat transfer communication with the collected reservoir fluid, but externally of the collection reservoir, and (ii) evaporation of any heating fluid that is present within the collected reservoir fluid, is promoted, so as to return the heating fluid to the reservoir for effecting mobilization of the hydrocarbon-comprising material within the reservoir, and thereby contribute to the refluxing. As well, by promoting the evaporation, the produced fluid 224 that is being produced contains less heating fluid, thereby reducing energy requirements to transport the produced fluid to the surface (as there is less fluid volume to produce), and also reducing demands on separation processes for removal of heating fluid from the produced fluids.

In some embodiments, for example, the electrical heating of the collected reservoir fluid 226 by the second electric heater 220 is effected in response to sensing of a temperature, of the collected reservoir fluid disposed at the heel 204*c* of the production well 204, that is at or below a predetermined temperature that is based upon the boiling point of the liquid heating fluid at the pressure of the hydrocarbon reservoir portion from which the mobilized hydrocarbon-comprising material is being produced. In some embodiments, for example, prior to the electrical heating of the collected reservoir fluid by the second electric heater, a temperature, of the collected reservoir fluid that is disposed at the heel 204*c* of the production well 204, is sensed that is at or below a predetermined temperature that is based upon the boiling point of the liquid heating fluid at the pressure of the hydrocarbon reservoir portion from which the mobilized hydrocarbon-comprising material is being produced. In some embodiments, for example, the predetermined temperature is at or above the boiling point of the liquid heating fluid at the pressure of the hydrocarbon reservoir portion from which the mobilized hydrocarbon-comprising material is being produced. The purpose of having the predetermined temperature being at the boiling point of the liquid heating fluid at the pressure of the hydrocarbon reservoir portion from which the mobilized hydrocarbon-comprising material is being produced, is for evaporating liquid heating fluid that has collected within the well. Liquid heating fluid that has collected within the well would be disposed at or below the boiling point of the liquid heating fluid at the pressure of the hydrocarbon reservoir portion from which the mobilized hydrocarbon-comprising material is being produced (where the heating fluid, in the liquid state, is water, this would be the saturated steam temperature within the reservoir). By effecting electrical heating while the collected reservoir fluid is disposed at or below the boiling point of the liquid heating fluid at the pressure of the hydrocarbon reservoir portion from which the mobilized hydrocarbon-comprising material is being produced, the intention is to vaporize the liquid heating fluid that has collected within the well as part of the collected reservoir fluid. In some embodiments, for example, it may be intended to vaporize the heating fluid that is disposed externally of the well, in which case the predetermined temperature may be above the boiling point of the liquid heating fluid at the pressure of the hydrocarbon reservoir portion from which the mobilized hydrocarbon-comprising material is being produced, for purposes of precluding collection of the heating fluid within the well.

As discussed above, in some embodiments, for example, the collected reservoir fluid 226 consists of, or substantially consists of, the mobilized hydrocarbon-comprising material. In those embodiments where the second electric heater 206 is disposed in direct heat transfer communication with the collected reservoir fluid, by having the collected reservoir fluid consisting of, or substantially consisting of, the mobilized hydrocarbon-comprising material, evaporation of condensed heating fluid disposed in heat transfer communication with the collected reservoir fluid, may produce evaporated heating fluid having a relatively higher temperature, owing to the fact that the mobilized hydrocarbon-comprising material can be heated to higher temperatures by the second electric heater, and transfer this higher quality heat to any condensed heating fluid disposed in heat transfer communication with the collected reservoir fluid, versus direct heating of the condensed heating fluid by the second electric heater (without any intervening liquid heat transfer medium 704).

Also, by having the collected reservoir fluid 226 consist of, or substantially consist of, mobilized hydrocarbon-comprising material, scale formation within the production well 204 may be mitigated. Where the heating fluid, in its liquid state, includes water, it is preferable that water does not become disposed with structures within the production well, including the second electric heater 206, as evaporation of water in this context may result in precipitation of dissolved scale-forming solids within the production well, including onto the second electric heater or other structures, resulting in scale formation. Accordingly, in such embodiments, by ensuring that the collected reservoir fluid consists of, or substantially consists of, mobilized hydrocarbon-comprising material, the collected heating fluid is fluidically isolated, or substantially fluidically isolated, from the production well, thereby mitigating potential scale formation within the production well (including scale formation on the second electric heater).

Further, as a necessary incident, by having the collected reservoir fluid 226 consist of, or substantially consist of, mobilized hydrocarbon-comprising material, production of a "drier" hydrocarbon material is facilitated. This reduces energy requirements to transport the produced fluid 224 to the surface 2006 (as there is less fluid volume to produce) and also reduces demands on separation processes for removal of heating fluid from the produced fluids.

In this respect, in some embodiments, for example, the rate of heating of the collected reservoir fluid by the second electric heater 220 is modulated such that the collected reservoir fluid 226 consists of, or substantially consists of, the mobilized hydrocarbon-comprising material.

In some embodiments, for example, the composition of the collected reservoir fluid 226 may be sensed by a densitometer. In this respect, the rate of heating effected by the electric heater 220 may be modulated based on sensing of the density of the collected reservoir fluid by the densitometer. In response to sensing of a density of the collected reservoir fluid that is characteristic of a collected reservoir fluid having excessive non-hydrocarbon-comprising fluid (such as the heating fluid), the rate of heating by the electric heater 220 may be increased to effect evaporation of the fluid. This will promote the maintenance of a collected reservoir fluid that consists of hydrocarbon-comprising material, or substantially hydrocarbon-comprising material. This promotes reflux of the condensed heating fluid (as above-described), higher quality heat transfer to effect the evaporation of the condensed heating fluid, mitigates scale formation, and production of "drier" hydrocarbon-comprising material.

In some embodiments, for example, the electric heater 220 is submerged within the collected reservoir fluid 226 (consisting of hydrocarbon-comprising material, or substantially hydrocarbon-comprising material), and the producing is modulated such that sufficient collected reservoir fluid is maintained within the production well 204 such that the electric heater is submerged within collected reservoir fluid.

In some embodiments, for example, the laterally extending section 204*a* of the production well 204 is disposed below that of the laterally extending section of the non-production well 202. In some of these embodiments, for example, the laterally extending section of the production well 204 is disposed in alignment, or substantially alignment, with the laterally extending section of the non-production well 202.

In some embodiments, for example, the laterally, or substantially laterally, extending section 204*a* of the production well 204 is co-operatively configured with the electric heater 220 such that while the reservoir fluid is being conducted towards the well 204, the laterally, or substantially laterally, extending section of the production well is disposed to receive and collect the reservoir fluid across (but not necessarily continuously across) an operative portion of the laterally, or substantially laterally, extending section of the production well, and the length of the operative portion, measured along the axis of the operative portion, is at least 1000 meters. Because the heating fluid is not supplied from the surface, heat losses, associated with longer wells, is not concerning, as it is for SAGD operations. Also, because the volumetric flow of produced fluid is relatively less than for SAGD production, hydraulic pressure losses are also not a material factor for well design. In combination, this enables the use of longer wells in in situ-reflux operations to effect production of hydrocarbon-comprising material, although shorter wells (i.e. those less than 1000 meters) could also be used.

In some embodiments, for example, the vertically, or substantially vertically, extending section 204*b* of the production well 204 has a length, measured along the axis of the vertically, or substantially vertically, extending section, of at least 1000 meters, so as to allow production from deeper resources. Again, heat losses and hydraulic pressure losses, with in-situ reflux are not concerning, as it is for SAGD operations, and it is, possible to, therefore, use longer wells, although shorter wells (i.e. those less than 1000 meters in depth) could also be used.

In some embodiments, for example, heating fluid may be lost to the reservoir, and make-up heating fluid may be required. In this respect, while the heating of a liquid heating fluid is being effected, supplemental liquid heating fluid 218 may be supplied from a source disposed above the surface 2002. In this respect, the liquid heating fluid includes the supplemental liquid heating fluid. In some embodiments, for example, the supplying of supplemental liquid heating fluid 118 is effected via an injector string 216 disposed within the non-production well 202. In some embodiments, for example, the injector string includes a "spaghetti string". In some embodiments, for example, the supplying of the supplemental liquid heating fluid is effected in response to sensing of a pressure, within the hydrocarbon reservoir portion from which the mobilized hydrocarbon-comprising material is being produced, that is less than a predetermined pressure. The predetermined pressure is based on, amongst other things, the desirability of operating at higher pressures in order to provide a greater driving force for production, balanced versus the recognition that heat transfer efficiency is more efficient at lower pressures and that cap rock integrity may limit the maximum possible operating pressure. The injector string 216 may be disposed outside of the well, and could also be used to inject heating fluid during start-up.

In some embodiments, for example, where the hydrocarbon reservoir contains relatively less viscous hydrocarbon-comprising material that is targeted for production, the non-production and production wells 202, 204 may be spaced apart a relatively greater distance than SAGD well pairs, such as by a spacing distance that is greater than five (5) meters, such as ten (10) meters.

In operation, evaporation of the heating fluid is effected by the heat generated by the electric heater 206. The evaporated heating fluid is conducted to the hydrocarbon reservoir and transfers heat energy to the hydrocarbon-comprising material such that the hydrocarbon-comprising material is mobilized and the heating fluid is condensed. Reservoir fluid enters the non-production well 202 via ports 208, collects within the collection reservoir 210 and is heated by the first electric heater 206 (either directly or via the heater assembly). The heating is controlled such that the reservoir fluid is primarily collected mobilized hydrocarbon-comprising material. The heated reservoir fluid transfers heat to condensed heating fluid that is disposed in heat transfer communication with the reservoir fluid, thereby effect re-evaporation of the condensed heating fluid, and thereby effect the reflux 214. After a period of time, an evaporated heat fluid chamber develops (where the heating fluid, in the liquid state, is water, then a steam chamber would be developed).

Reservoir fluid 226 also drains, by gravity, enters the production well 204 through ports 222, and is collected within the collection reservoir defined within the production well 204, and is heated by the second electric heater. The heating is controlled such that the reservoir fluid is primarily collected mobilized hydrocarbon-comprising material. The heated reservoir fluid transfers heat to any condensed heating fluid that is disposed in heat transfer communication with the reservoir fluid, thereby effect re-evaporation of the condensed heating fluid, and thereby effect the reflux 228, and also thereby providing a drier hydrocarbon-comprising material for production. The hydrocarbon-comprising material may be produced using reservoir pressure or with assistance of artificial lift, such as with a downhole pump or gas lift.

Figure 3:
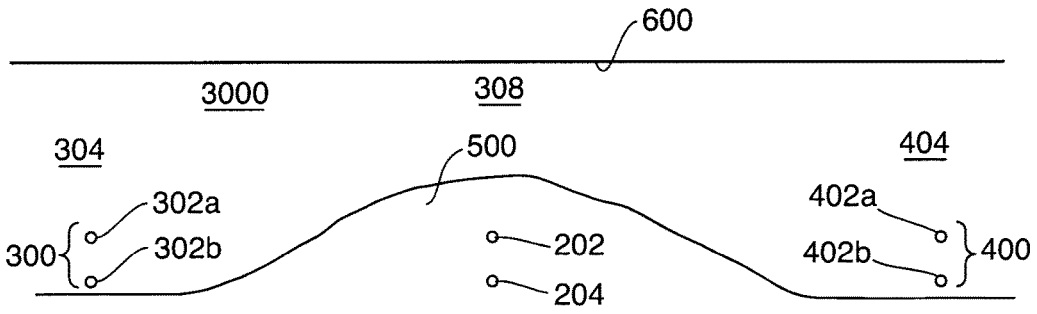
FIG. 3 is a schematic illustration of an embodiment of a system used to implement the in-situ reflux process within a wedge zone.

Referring to FIG. 3, in another aspect, there is provided a process for producing hydrocarbon-comprising material from an hydrocarbon reservoir using two adjacent SAGD well pairs 300, 400, wherein, after the SAGD well pairs 300, 400 have already been operating for a period of time, the in-situ reflux process is implemented within a residual or "wedge" zone 500, disposed between the SAGD well pairs, which has not been produced, or substantially produced, by the operation of the SAGD well pairs.

In this respect, the process includes:

operating a first steam-assisted gravity drainage ("SAGD") system including the SAGD well pair 300, the SAGD well pair 300 including a first SAGD injection well 302*a* and a first SAGD production well 302*b*, such that hydrocarbon-comprising material is produced from the first SAGD production well 304*b;* operating a second SAGD system including the well pair 400, the well pair 400 including a second SAGD injection well 402*a* and a second SAGD production well 402*b*, such that hydrocarbon-comprising material is produced from the second SAGD production well 402*b*; and after respective hydrocarbon-comprising material production has been effected by each one of the operation of the first SAGD system and the operation of the second SAGD system, independently, operating an in-situ reflux process, wherein the operating an in-situ reflux process includes:

within the hydrocarbon reservoir 3000, electrically heating a liquid heating fluid such that the liquid first heating fluid is evaporated to produce a gaseous first heating fluid;

heating hydrocarbon-comprising material, within an intermediate hydrocarbon reservoir zone 500 disposed between the first and second SAGD well pairs 300, 400, with the gaseous heating fluid such that the heated hydrocarbon-comprising material is mobilized and such that the gaseous heating fluid is condensed to produce a condensed heating fluid; and electrically heating at least a fraction of the condensed heating fluid such that the at least a condensed heating fluid fraction is re-evaporated;

and while the evaporation, the condensing, and the re-evaporation is being effected, producing reservoir fluid, including at least a fraction of the mobilized hydrocarbon-comprising material, through the intermediate production well 204 disposed within the intermediate hydrocarbon reservoir zone 500.

Figure 4:
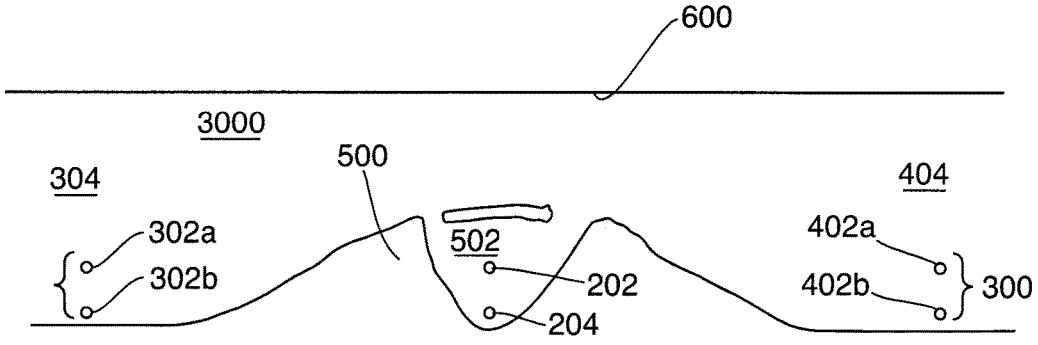
FIG. 4 is a schematic illustration of an embodiment of a system that is implementing the in-situ reflux process within a wedge zone after fluid communication has been established between the refluxing heating fluid in the wedge zone and the SAGD steam chambers.

In some embodiments, for example, the operating of the in-situ reflux process effects fluid communication between the intermediate production well 204 and the injection well 302*a* or 402*a* of at least one of the SAGD well pairs 300, 400 (see FIG. 4). In this respect, the operation of the in-situ reflux process effects creation of an evaporated heating fluid chamber 502 (where the heating fluid, in the liquid state, is water, then a steam chamber would be created) that eventually effects fluid communication between the injection well (302*a* and 402*a*) and the well 204 In this respect, in some embodiments, for example, after the fluid communication has been established between the intermediate production well and the injection well of at least one of the first and second SAGD well pairs, the process further includes shutting in the production well of the SAGD well pair having the injection well with which the intermediate production well has established fluid communication. In this respect, after such fluid communication has been established, the hydrocarbon-comprising material being mobilized via the SAGD operation could be produced by the intermediate production well. This may be particularly suitable when the drainage angles of a steam chamber of a more mature SAGD operation are relatively low, and draining of hydrocarbon-comprising material may be relatively faster through the fluid channels that have been established while operating the in-situ reflux process within the zone that is disposed between the adjacent SAGD well pairs.

In some embodiments, for example, wherein the operating of the in-situ reflux process is initiated after both of: (i) the operating of the first SAGD system and (ii) the operating of the second SAGD system have been suspended. In this respect, operations involving the first and second SAGD systems may be fairly mature, and production rates are fairly low to justify continued operation, resulting in the opportunity for in-situ reflux process to replace production.

In some embodiments, for example, the operating of a first SAGD system effects creation of a first SAGD steam chamber 304; and the operating of a second SAGD system effects creation of a second SAGD steam chamber 404; and the operating of the in-situ reflux process effects creation of an intermediate heating fluid chamber 502 within the intermediate hydrocarbon reservoir zone 500. The operating of the first and second SAGD systems is such that a residual zone, within the hydrocarbon reservoir, is defined between the first and second SAGD steam chambers, wherein the intermediate production well 204 is disposed within the residual (or "wedge") zone 500.

Referring again to FIG. 4, in some embodiments, for example, the operating of a first SAGD system, the operating of a second SAGD system, and the operating of the intermediate production well 204 co-operate such that fluid communication is established between the intermediate steam chamber 502 and at least one of the first and second SAGD steam chambers 304 or 404. After the fluid communication has been established between the intermediate steam chamber and at least one of the first and second SAGD steam chambers, the production well, of the SAGD well pair of the SAGD system whose operation has created the SAGD steam chamber with which the intermediate production well 204 has established fluid communication, may be shut-in, for the reasons that are above-described.

In some embodiments, for example, the operating of the in-situ reflux process is initiated after merger of the first and second SAGD steam chambers 304, 404 via interwell region 308.

Figure 5:
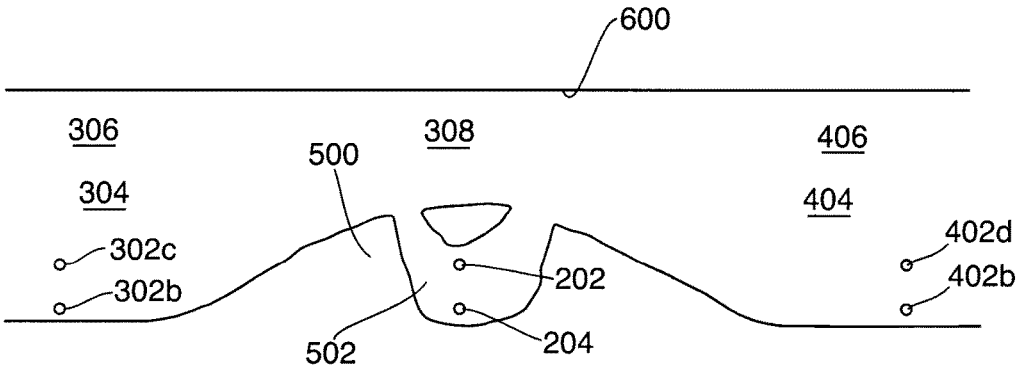
FIG. 5 is a schematic illustration of an embodiment of a system that is implementing the in-situ reflux process within a wedge zone, and an in-situ combustion process in a steam swept zone using existing SAGD injection wells for effecting supply of oxidant and effecting removal of combustion gases, after communication has been established between the refluxing heating fluid in the wedge zone and the SAGD steam chambers.
Figure 6:
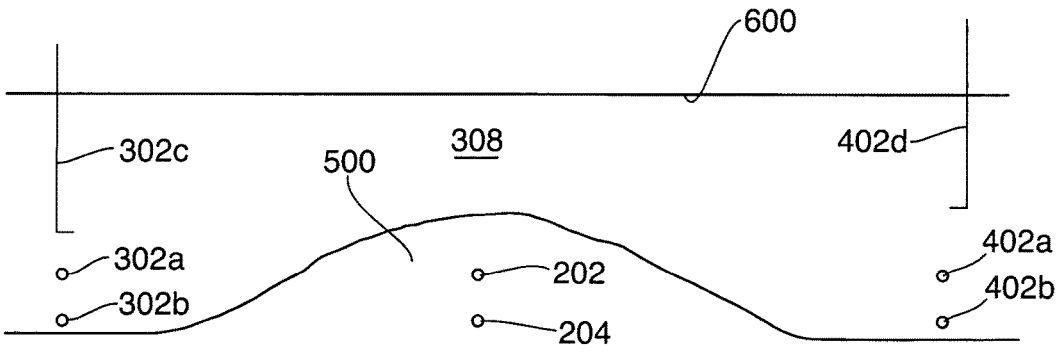
FIG. 6 is a schematic illustration of an embodiment of a system used to implement the in-situ reflux process within a wedge zone, and an in-situ combustion process in a steam swept zone using a separate oxidant injector and vent.

Referring to FIGS. 5 and 6, in some embodiments, the SAGD operations may be converted to incorporate both an in-situ reflux process and an in-situ combustion process. The operation of an in-situ combustion process, in combination with the in-situ reflux process, may improve production rates and promote more efficient recovery of hydrocarbon-comprising material.

In this respect, in some embodiments, for example, the first SAGD steam chamber 304 may be said to define a first steam swept zone 306, and the second SAGD steam chamber 404 may be said to define a second steam swept zone 406, and the process further comprises combusting a fraction of the residual hydrocarbon-comprising material within at least one of first and second steam swept zones. The combusting of the residual hydrocarbon-comprising material increases temperature conditions and produces steam within the reservoir, thereby enabling mobilization and recovery of other residual hydrocarbon-comprising material. In some embodiments, for example, the production well, of the SAGD well pair of the SAGD system whose operation has created the SAGD steam chamber which defines the associated steam swept zone within which the combusting is being effected, receives and produces the hydrocarbon-comprising material mobilized by the combusting.

In some embodiments, for example, each one of: (i) the operating of the intermediate production well 204 and (ii) the combusting of a fraction of the residual hydrocarbon-comprising material is initiated, independently, after merger of the first and second SAGD steam chambers 304, 404. Merger of the first and second steam chambers via the region 308 (typically, just below the cap rock 600), is a signal indicative of maturation of the SAGD operations, and may function as a trigger to rely on other enhanced oil recovery processes, such as in-situ reflux and in-situ combustion processes, to effect hydrocarbon-comprising material production.

In some embodiments, for example, the operating of a first SAGD system, the operating of a second SAGD system, and the operating of the intermediate production well 204 co-operate such that fluid communication is established between the intermediate steam chamber 502 and at least one of the first and second steam swept zones 306, 406, and the combusting of a fraction of the residual hydrocarbon-comprising material is being effected within such steam swept zone while the fluid communication between the intermediate production well and such steam swept zone has been established.

By virtue of such fluid communication, steam produced by the combustion may be conducted to the residual zone 500 within which the in-situ reflux process is being operated, and thereby provide make-up heating fluid to assist with production of hydrocarbon-comprising material within the residual zone. Also, operation of the in-situ reflux process creates additional steam swept zone-containing residual hydrocarbon-comprising material which may be available for recovery by the combustion process. As well, the in-situ reflux, in producing its own associated heating fluid chamber within the residual zone, produces a heating fluid chamber 502 with relatively steeper drainage angles than those within the steam swept zones 306, 406 where the combustion is occurring, thereby providing a more efficient route to receive and produce hydrocarbon-comprising material that is mobilized by the combustion.

In some embodiments, for example, the combusting of a fraction of the residual hydrocarbon-comprising material is initiated within such steam swept zone 306 or 406 only after the fluid communication between the intermediate production well 204 and such steam swept zone 306 or 406 has been established In some embodiments, for example, each one of: (i) the operating of the in-situ reflux process and (ii) the combusting of a fraction of the residual hydrocarbon-comprising material is initiated, independently, after suspending injection of steam through the injection well 302*a* or 402*a* of, with respect to each one of the at least one steam swept zone within which the residual hydrocarbon-comprising material is combusted, the SAGD well pair 300 or 400 of the SAGD system that has been operated to create the SAGD steam chamber 304*a* or 304*b* which defines the steam swept zone 306*a* or 306*b*.

Referring to FIG. 5, in some embodiments, for example, the injection well 302*a* or 402*a* of one of the SAGD well pairs 300, 400 be converted to effect delivery of oxidant to a steam swept zone for effecting combustion within the steam swept zone. In this respect, in some embodiments, for example, the process further includes suspending injection of steam through the injection well (in the illustrated embodiment, this would be the well 302*a*) of at least one of the SAGD well pairs, converting the well 302*a* to an oxidant injection well 302*c*, and supplying oxidant to the steam swept zone via the oxidant injection well. The combusting of a fraction of the residual hydrocarbon-comprising material can be effected by the supplied oxidant. A separate fluid conductor could be inserted to the injection well for functioning as an injector to ensure that the oxidant is supplied to the steam swept zone at a sufficient rate in order to effect high temperature oxidation. Correspondingly, the injection well (in the illustrated embodiment, this would be the well 402*a*) of the other one of the adjacent SAGD well pairs can be converted to a vent gas removal well 402*d* to remove combustion gases from the reservoir.

Alternatively, and referring to FIG. 6, a separate injection wells 302*c* could be created to supply the oxidant to the steam swept zones, and a separate vent gas removal well 402*d* could be created to remove combustion gases from the reservoir.

The oxidant may be co-injected with other gaseous material, such as steam, through the oxidant injection well 302*c*.

Figure 7:
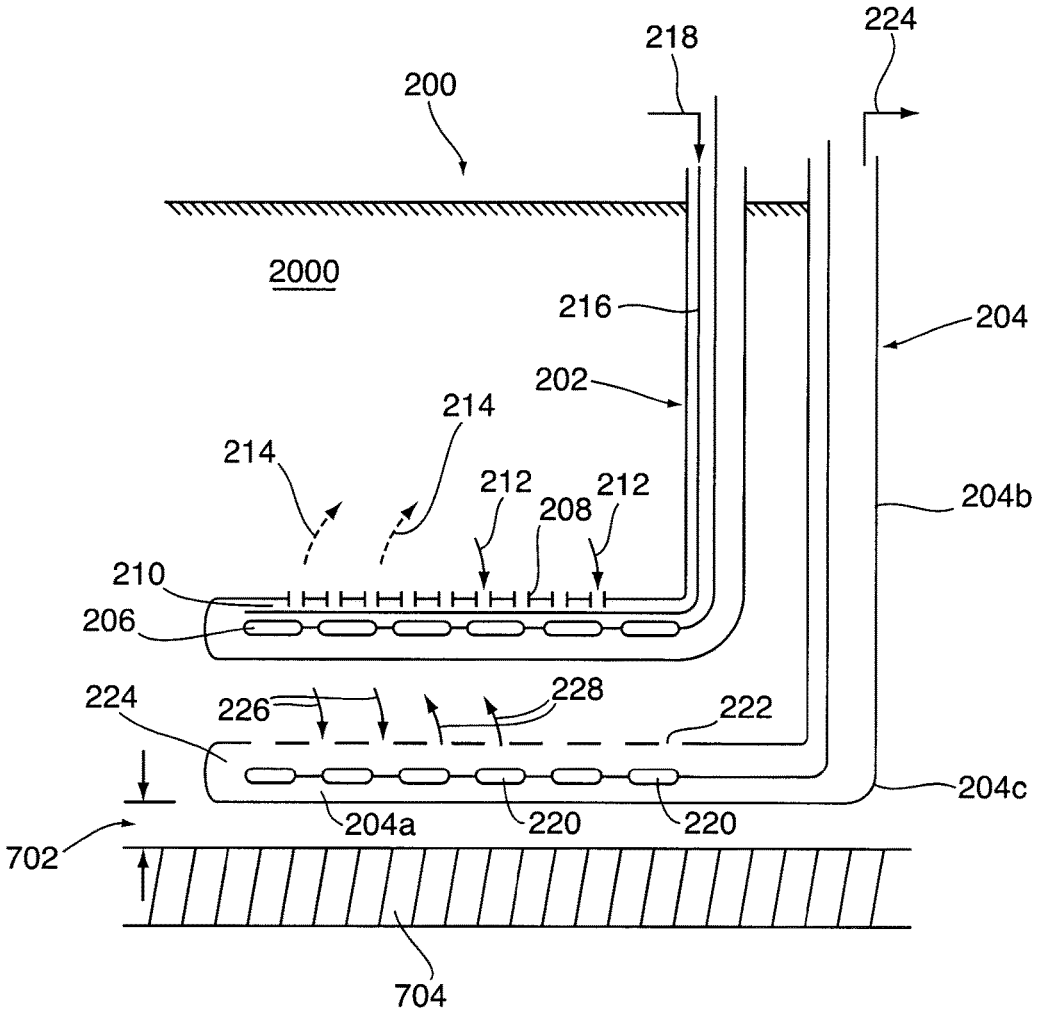
FIG. 7 a schematic illustration of an embodiment of a system used to implement the in-situ reflux process within a hydrocarbon reservoir having an active water zone.

Referring to FIG. 7, in a further aspect, the in-situ reflux process may be implemented within a hydrocarbon reservoir having an active water zone 704. As used herein, the term "active water zone" is defined as a zone within the hydrocarbon reservoir that includes water that, at the native-state reservoir conditions (such as before any recovery process starts) can move in response to a driving force, such as a pressure differential, and is characterized by a recharge rate of greater than or equal to 10 cubic meters per day. In some embodiments, for example, the active water zone is a bottom water zone. The bottom water zone is an active water zone that is underlying a liquid hydrocarbon-containing zone of the hydrocarbon reservoir.

The presence of active water zones within hydrocarbon reservoirs interfere with production of hydrocarbon material from a pay zone, when using some thermal enhanced oil recovery processes. For example, with SAGD, stream may be lost to the active water zone due to a hydraulic pressure gradient between the steam chamber and the active water zone, or fluid, from the active water zone, may invade the steam chamber, again due to a hydraulic pressure gradient. Such fluid incursion within the steam chamber may disrupt the SAGD process. To mitigate steam losses or fluid incursion from the active water zones, it has been suggested to reduce or eliminate pressure gradients between the SAGD steam chamber and the active water zone. However, pressure matching is difficult with SAGD, due to the difficulty in realizing steam conformance. Additionally, it has been suggested to operate SAGD at a higher pressure than the active water zone, with the premise that it is better to lose steam to the active water zone than to allow fluid incursion from the active water zone. However, this may result in significant stand-off distances, resulting in potentially significant quantities of sterilized hydrocarbon-comprising material beneath the stand-off plane.

Some of these problems are obviated when practising the in-situ reflux process in reservoirs containing active water zones.

Because hydraulic pressure drop within a production well 204 of an in-situ reflux process is not relatively significant (in comparison, for example, to that within a SAGD production well), pressure matching between the in-situ reflux process and the active water zone is more likely to be approached or realized.

Also, when using an electric heater 220 that includes a plurality of heater segments, each one of them being controllable independently from the others, heating fluid conformance is more likely approached or realized, which thereby mitigates the need to provide for large stand-off distances 702 to account for well placement deviations. In this respect, the minimum standoff distance 702 between a laterally, or substantially laterally, extending section of the production well 204, through which the produced fluid is being produced, and the active water zone is less than two (2) meters. In some embodiments, for example, the minimum stand-off distance is less than one (1) meter.

Incursion of water from the active water zones into the pay zone provides for a source of heating fluid for the in-situ reflux process. In this respect, in response to a pressure differential between the pressure within the active water zone 704 and the pressure of the hydrocarbon reservoir portion from which the mobilized hydrocarbon-comprising material is being produced, water may be received by the heating fluid reservoir from the active water zone. Once received within the heating fluid reservoir, the water from the active water zone is evaporated by the electric heater 220, thereby increasing pressure within the hydrocarbon reservoir portion from which the mobilized hydrocarbon-comprising material is being produced, and thereby inhibiting further incursion of water from the active water zone to the pay zone. Such dynamic stability is not attainable with SAGD.

In FIGS. 4 to 7, the production well 204 is shown in association with a non-production well 202, similar to the system 200 illustrated in FIG. 2, for implementing the in-situ reflux process. It is understood that the single-well design of the system 200 illustrated in FIG. 1, which includes the production well 102, could also be used to implement the in-situ reflux process in the context of the embodiments illustrated in FIGS. 4 to 7. It is understood the production wells 102, 204 and the non-production well 202 could be infill wells.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

What is claimed is:

1. A process for producing hydrocarbon-comprising material from a hydrocarbon reservoir comprising:

within the hydrocarbon reservoir, electrically heating a liquid heating fluid, such that the liquid heating fluid is evaporated to produce a gaseous heating fluid;

heating hydrocarbon-comprising material with the gaseous heating fluid such that the heated hydrocarbon-comprising material is mobilized and such that the gaseous heating fluid is condensed to produce a condensed heating fluid;

electrically heating the condensed heating fluid such that the condensed heating fluid is re-evaporated;

while the evaporation, the condensing, and the re-evaporation are being effected, producing produced fluid, wherein the produced fluid includes at least a fraction of the mobilized hydrocarbon-comprising material;

wherein a reflux is effected, and wherein the reflux includes the combination of the evaporation, the condensing and the re-evaporation;

wherein at least a fraction of the reflux is effected by an electric heater that is disposed in indirect heat transfer communication with at least a fraction of the condensed heating fluid;

wherein the electric heater is disposed within a housing, and a liquid heat transfer fluid having a boiling point that is greater than the boiling point of the liquid heating fluid at the pressure of the hydrocarbon reservoir portion from which the mobilized hydrocarbon-comprising material is being produced, is disposed within the housing between the heater and an internal surface of the housing, such that a heater assembly is provided that includes the housing, the electric heater, and the heat transfer fluid;

wherein the heater assembly is disposed within a collection reservoir configured for receiving reservoir fluid; and wherein the heater assembly is configured for effecting heating of the reservoir fluid, such that the electrical heating of the condensed heating fluid is effected by electrical heating of the reservoir fluid by the heater assembly, and such that the electrical heating of the condensed heating fluid is effected by the step of electrically heating the reservoir fluid by the heater assembly;

and further comprising:

prior to the electrical heating of the reservoir fluid, collecting the reservoir fluid within the collection reservoir.

2. The process as claimed in claim 1;

wherein electrical heating of the liquid heat transfer fluid by the electric heater effects the electrical heating of the collected reservoir fluid;

and wherein the electrical heating of the liquid heat transfer fluid is such that the temperature of the liquid heat transfer fluid is greater than the boiling point of the liquid heating fluid, at the pressure of the hydrocarbon reservoir portion from which the mobilized hydrocarbon-comprising material is being produced, by at least 50 degrees Celsius.

3. The process as claimed in claim 2;

wherein at least a fraction of the reflux is effected by an electrical heater that is disposed within a collection reservoir configured for receiving reservoir fluid and indirect heat transfer communication with at least a fraction of the condensed heating fluid;

and wherein the electric heater is configured for effecting heating of the reservoir fluid, such that the electrical heating of the condensed heating fluid is effected by electrical heating of the collected reservoir fluid by the electric heater, such that the electrical heating of the at least a fraction of the condensed heating fluid is effected by the step of electrically heating the collected reservoir fluid by the electric heater;

and further comprising:

prior to the electrical heating of the reservoir fluid, collecting the reservoir fluid within the collection reservoir.

4. The process as claimed in claim 3;

wherein the producing of the produced fluid is effected via a production well that is disposed within the hydrocarbon reservoir;

and wherein the collection reservoir is disposed within the production well;

and wherein the collected reservoir fluid consists of, or substantially consists of, the hydrocarbon-comprising material.

5. The process as claimed in claim 4, further comprising:

modulating the heating of the collected reservoir fluid is such that the collected reservoir fluid consists of, or substantially consists of, the hydrocarbon-comprising material.

6. A process for producing hydrocarbon-comprising material from a hydrocarbon reservoir comprising: within the hydrocarbon reservoir, electrically heating a liquid heating fluid, such that the liquid heating fluid is evaporated to produce a gaseous heating fluid; heating hydrocarbon-comprising material with the gaseous heating fluid such that the heated hydrocarbon-comprising material is mobilized and such that the gaseous heating fluid is condensed to produce a condensed heating fluid; electrically heating the condensed heating fluid such that the condensed heating fluid is re-evaporated; and while the evaporation, the condensing, and the re-evaporation are being effected, producing produced fluid, wherein the produced fluid includes at least a fraction of the mobilized hydrocarbon-comprising material; wherein reflux is effected, and wherein the reflux includes the combination of the evaporation, the condensing and the re-evaporating; wherein at least a fraction of the reflux is effected by an electrical heater that is disposed within a collection reservoir configured for receiving reservoir fluid and in indirect heat transfer communication with at least a fraction of the condensed heating fluid; wherein the electric heater is a first electric heater that is disposed within a non-production well that is disposed within the hydrocarbon reservoir; wherein the at least a fraction of the reflux is effected by the first electric heater; and wherein the producing of the produced fluid is effected via a production well that is disposed below the non-production well within the hydrocarbon reservoir.

7. The process as claimed in claim 6;

wherein another fraction of the reflux is effected by a second electric heater that is disposed within the production well.

8. The process as claimed in claim 7;

wherein the second electric heater is disposed in indirect heat transfer communication with another fraction of the condensed heating fluid;

wherein the second electric heater is disposed within a housing, and liquid heat transfer fluid, having a boiling point that is greater than the boiling point of the liquid heating fluid at the pressure of the hydrocarbon reservoir portion from which the mobilized hydrocarbon-comprising material is being produced, is disposed within the housing between the heater and an internal surface of the housing, such that a heater assembly is provided that includes the housing, the second electric heater, and the heat transfer fluid;

and wherein the heater assembly is disposed within a collection reservoir configured for receiving reservoir fluid;

and wherein the heater assembly is configured for effecting heating of the reservoir fluid, such that the electrical heating of the condensed heating fluid is effected by electrical heating of the reservoir fluid by the heater assembly, and such that the electrical heating of the another fraction of the condensed heating fluid is defined by the step of electrically heating the reservoir fluid by the heater assembly;

and further comprising:

prior to the electrical heating of the reservoir fluid, collecting the reservoir fluid within the collection reservoir.

9. The process as claimed in claim 8;

wherein electrical heating of the liquid heat transfer fluid by the electric heater effects the electrical heating of the collected reservoir fluid;

and wherein the electrical heating of the liquid heat transfer fluid is such that the temperature of the liquid heat transfer fluid is greater than the boiling point of the liquid heating fluid, at the pressure of the hydrocarbon reservoir portion from which the mobilized hydrocarbon-comprising material is being produced, by at least 50 degrees Celsius.

10. A process for producing hydrocarbon-comprising material from a hydrocarbon reservoir comprising:

operating a first steam-assisted gravity drainage ("SAGD") system including a first SAGD well pair, the first SAGD well pair including a first SAGD injection well and a first SAGD production well such that hydrocarbon-comprising material is produced from the first SAGD production well;

operating a second SAGD system including second SAGD well pair, the second SAGD well pair including a second SAGD injection well and a second SAGD production well such that hydrocarbon-comprising material is produced from the second SAGD production well; and after respective hydrocarbon-comprising material production has been being effected by each one of the operation of the first SAGD system and the operation of the second SAGD system, independently, operating an in-situ reflux process, wherein the operating of an in-situ reflux process includes:

within the hydrocarbon reservoir, electrically heating a liquid heating fluid such that the liquid heating fluid is evaporated to produce a gaseous heating fluid;

heating hydrocarbon-comprising material, within an intermediate hydrocarbon reservoir zone disposed between the first and second SAGD well pairs, with the gaseous heating fluid such that the heated hydrocarbon-comprising material is mobilized and such that the gaseous heating fluid is condensed to produce a condensed heating fluid; and electrically heating at least a fraction of the condensed first heating fluid such that the at least a condensed heating fluid fraction is re-evaporated;

and while the evaporation, the condensing, and the re-evaporation is being effected, producing reservoir fluids, including at least a fraction of the mobilized hydrocarbon-comprising material, through an intermediate production well disposed within the intermediate hydrocarbon reservoir zone;

wherein the operating of a first SAGD system effects creation of a first SAGD steam chamber and wherein the operating of a second SAGD system effects creation of a second SAGD steam chamber, and wherein the operating of an in-situ reflux process effects creation of an intermediate steam chamber within the intermediate hydrocarbon reservoir zone;

wherein the first SAGD steam chamber defines a first steam swept zone, and wherein the second SAGD steam chamber defines a second steam swept zone;

and further comprising combusting residual hydrocarbon-comprising material within at least one of first and second steam swept zones to effect mobilization of other residual hydrocarbon-comprising material.

11. A process for producing hydrocarbon-comprising material from a hydrocarbon reservoir comprising:

operating a first steam-assisted gravity drainage ("SAGD") system including a first SAGD well pair, wherein the first SAGD well pair includes a first SAGD injection well and a first SAGD production well such that hydrocarbon-comprising material is produced from the first SAGD production well;

operating a second SAGD system including a second SAGD well pair, wherein the second SAGD well pair includes a second SAGD injection well and a second SAGD production well such that hydrocarbon-comprising material is produced from the second SAGD production well;

after a first steam chamber has been formed by operation of the first SAGD system and a second steam chamber has been formed by operation of the second SAGD system, and respective hydrocarbon-comprising material production has been being effected from each one of the operation of the first SAGD system and the operation of the second SAGD system, independently, such that a wedge zone has been formed within the hydrocarbon reservoir between the first and second steam chambers, operating an in situ-reflux process within the wedge zone for producing hydrocarbon-comprising material from the wedge zone, wherein operating the in-situ reflux process includes operating a process as claimed in claim 1, wherein the production well, through which production of the produced fluid is being effected during the in-situ reflux process, is an intermediate production well;

wherein the operating of the in-situ reflux process effect fluid communication between the intermediate production well and the injection well of at least one of the SAGD well pairs; and after the fluid communication has been established between the intermediate production well and the injection well of at least one of the first and second SAGD well pairs, shutting in the production well of the SAGD well pair having the injection well with which the intermediate production well has established fluid communication.

12. The process as claimed in claim 11;

wherein the operating of the in-situ reflux process is initiated after both of (i) the operating of the first SAGD system and (ii) the operating of the second SAGD system have been suspended;

and wherein the operating of a first SAGD system, the operating of a second SAGD system, and the operating of the in-situ reflux process co-operate such that fluid communication is established between the intermediate steam chamber and at least one of the first and second SAGD steam chambers.

* * * * *